United States Patent [19]

Silverman et al.

[11] Patent Number: 5,029,356

[45] Date of Patent: Jul. 9, 1991

[54] SEWER AUGERING APPARATUS

[75] Inventors: Lee Silverman; Norman J. Borgo, both of Pittsburgh, Pa.

[73] Assignee: General Wire Spring Company, McKees Rocks, Pa.

[21] Appl. No.: 517,431

[22] Filed: May 3, 1990

Related U.S. Application Data

[63] Continuation-in-part of Ser. No. 412,180, Sep. 25, 1989, abandoned.

[51] Int. Cl.[5] ..... B08B 9/02

[52] U.S. Cl. ..... 15/104.33; 279/50; 279/121; 279/122

[58] Field of Search ..... 15/104.33

[56] References Cited

U.S. PATENT DOCUMENTS

| | | | |
|---|---|---|---|
| 3,093,854 | 6/1963 | Silverman | 15/104.3 |
| 3,224,024 | 12/1965 | Hunt | 15/104.3 |
| 3,246,354 | 4/1966 | Cooney et al. | 15/104.3 |
| 3,394,599 | 7/1968 | Tucker | 74/25 |
| 3,449,782 | 6/1969 | Hunt | 15/104.3 |
| 3,451,089 | 6/1969 | Carlson et al. | 15/104.3 |
| 3,451,090 | 6/1969 | Lopresti et al. | 15/104.3 |
| 3,609,788 | 10/1971 | Mier | 15/104.3 |
| 3,691,583 | 9/1972 | Silverman et al. | 15/104.3 |

FOREIGN PATENT DOCUMENTS

| | | | |
|---|---|---|---|
| 3005724 | 9/1980 | Fed. Rep. of Germany | 15/104.33 |

*Primary Examiner*—Edward L. Roberts

*Attorney, Agent, or Firm*—Carothers & Carothers

[57] ABSTRACT

A sewer augering apparatus and more particularly a sewer augering apparatus having a power feed and manual lock apparatus with actuation thereof by an, axially slideable actuator.

18 Claims, 4 Drawing Sheets

SEWER AUGERING APPARATUS

This is a continuation-in-part of co-pending application Ser. No. 07/412,180 filed on 09/25/89, now abandoned.

BACKGROUND OF THE INVENTION

In the art of drain and sewer cleaning equipment the so-called plumbers snake or sewer augering apparatus is a well known expedient for clearing pipes of all sorts of obstructions. The apparatus typically comprises an elongated flexible snake, commonly in the form of an elongated tightly coiled spring, which is wound in a rotary canister for feeding of the snake from a suitable feed aperture or opening which is normally positioned on the axis of rotation of the canister.

In some snake apparatus, the snake is fed manually from the canister by simply pulling a desired length of the coiled snake from the canister opening. The incremental length of snake is then manually fed into the pipe or drain to be cleaned in conjunction with rotation of the canister, which in turn rotates the snake extending therefrom. When withdrawing a length of snake from a pipe, it is manually pushed back into the canister through the access opening whereupon the snake spontaneously forms into successive coils within the canister.

Other plumbers snake apparatus is known which incorporates a power feed in the form of rollers or similar drive elements that engage the exterior surface of the snake, but which at the same time are not rotatable about the axis of rotation of the canister. The rollers typically may be rotatable independently about respective axes of rotation which extend in non-parallel relation with respect to the axial extent of the snake element. Thus, as the canister and snake element are rotated, the feed rollers or other such guide elements in engagement with the exterior periphery of the snake element trace a spiral path in the axial direction along the snake element. Since the guide rollers are held axially stationary, the result is that the snake element is subjected to powered feed from the canister and into the drain or pipe to be cleared.

For both powered and manual feed plumbers snakes, the rotation of the canister and snake element serves to rotate an auger bit, cutter or other drain clearing element mounted at the forwardmost end of the snake whereby the rotating bit dislodges and clears obstructions encountered as the fowardmost end of the snake is fed through the drain or pipe.

Also known in the art are manual lock mechanisms for manual feed plumbers snakes which serve to grip the snake and retain it against unintended infeed or outfeed to or from the canister during operation. Such lock mechanisms have included spring loaded, radially moveable tab elements which are moved radially into and out of engagement with the snake element as desired in operation. Such lock mechanisms permit manual feed pressure to be applied axially on the snake during operation to thereby force the leading end of the snake element through the pipe. Without a lock mechanism, such axial force would tend to feed the snake backwards into the canister rather than forward into the drain or pipe.

The following patents disclose some of the above and various other aspects of known plumbers snake and similar apparatus: U.S. Pat. Nos. 3,394,599, 3,451,089, 3,451,090, 3,224,024, 3,449,782, 3,609,788, 3,093,854, 3,246,354 and 3,691,583.

Notwithstanding the variety of known plumbers snake apparatus developed hitherto, practitioners of the art have continually sought improvements to provide greater ease and reliability of operation, simplification of design structure, and ways of combining desirable operational features for convenient application and use in relatively small and simple structural packages.

BRIEF SUMMARY OF THE INVENTION

The present invention contemplates a plumbers snake apparatus generally of the type characterized hereinabove but having novel and improved feed and lock functions, and a simplified control apparatus for operation thereof. More specifically, our invention contemplates a plumbers snake apparatus, preferably of the portable hand held type, in which a single control element is comprised of a sleeve assembly which is disposed in axially encompassing relationship with respect to an axially rotatable spindle that projects from a plumbers snake canister. The sleeve assembly is operable to actuate a power feed apparatus that is carried thereby, and which is therefore maintained non-rotatable with respect to the spindle and the snake element, and an actuator for a lock apparatus which preferably is carried by the rotary spindle. The sleeve assembly includes an external sleeve element which serves as a hand grip and which is also axially moveable between lock actuating and feed actuating positions. The handgrip sleeve also may include an axially intermediate position where neither the drive apparatus nor the lock apparatus is engaged. In an alternative embodiment, the invention additionally contemplates a separately actuated means to enhance the ease of maintaining the power feed in engagement with a snake for power feeding thereof.

The invention thus affords a structurally simple yet reliable, easily operated snake apparatus in which the sleeve element serves as a hand grip to support the forward end of the plumbers snake apparatus and additionally is axially slideable to actuate lock and power feed mechanisms. Typically, the user of the novel snake apparatus will grasp the hand grip sleeve with one hand and hold in his other hand the handle of a pistol grip drill or similar power unit which is connected to the canister carrier such as shown in prior U.S. Pat. No. 3,691,583 referred to hereinabove.

It is therefore one object of the present invention to provide a novel and improved plumbers snake apparatus.

A further object of the invention is to provide a plumbers snake apparatus with a novel and improved actuator which provides independent and mutually exclusive actuation of lock and power feed apparatus.

A further object of the invention is to provide a plumbers snake apparatus such as characterized immediately above wherein an axially slideable manual actuator provides actuation of the lock and the power feed elements at its opposed extreme axial positions and also serves as a hand grip.

These and other objects and further advantages of the invention will be more readily appreciated upon consideration of the following detailed description and the accompanying drawings, in which.

Figure 1:
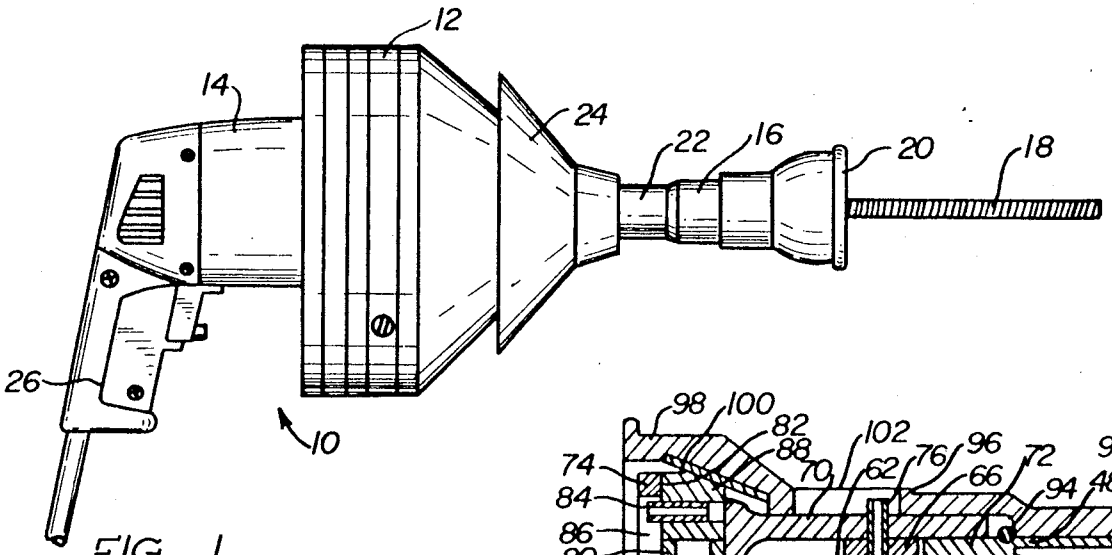
FIG. 1 is a side elevation of a plumbers snake apparatus according to one presently preferred embodiment of the instant invention.

There is generally indicated at 10 in FIG. 1 a plumbers snake apparatus comprised of an enclosure 12 which is mounted on the spindle or chuck of a portable apparatus such as a pistol grip drill 14 for rotation with the drill chuck or spindle. As is well known, a canister containing a coiled plumbers snake 18 is received within enclosure 12 and a spindle (not shown in FIG. 1) projects axially from the enclosure 12 so that upon actuation of drill 14 the enclosure 12, the contained canister, the spindle, and the snake 18 projecting axially through the axially open center of the spindle all rotate in unison.

Also shown in FIG. 1 is an actuator and control assembly 16 which encompasses the axially projecting spindle in a manner to be described hereinbelow such that snake 18 projects from an open outer end 20 of actuator 16. The exterior features of actuator 16 include perimeteral surface portions comprising a hand grip 22 and a conical shield 24 to permit easy, convenient and safe grasp of the unit by a user for support of the forward end of the apparatus 10 while the user grasps the drill handle 26 with his other hand.

Figure 2:
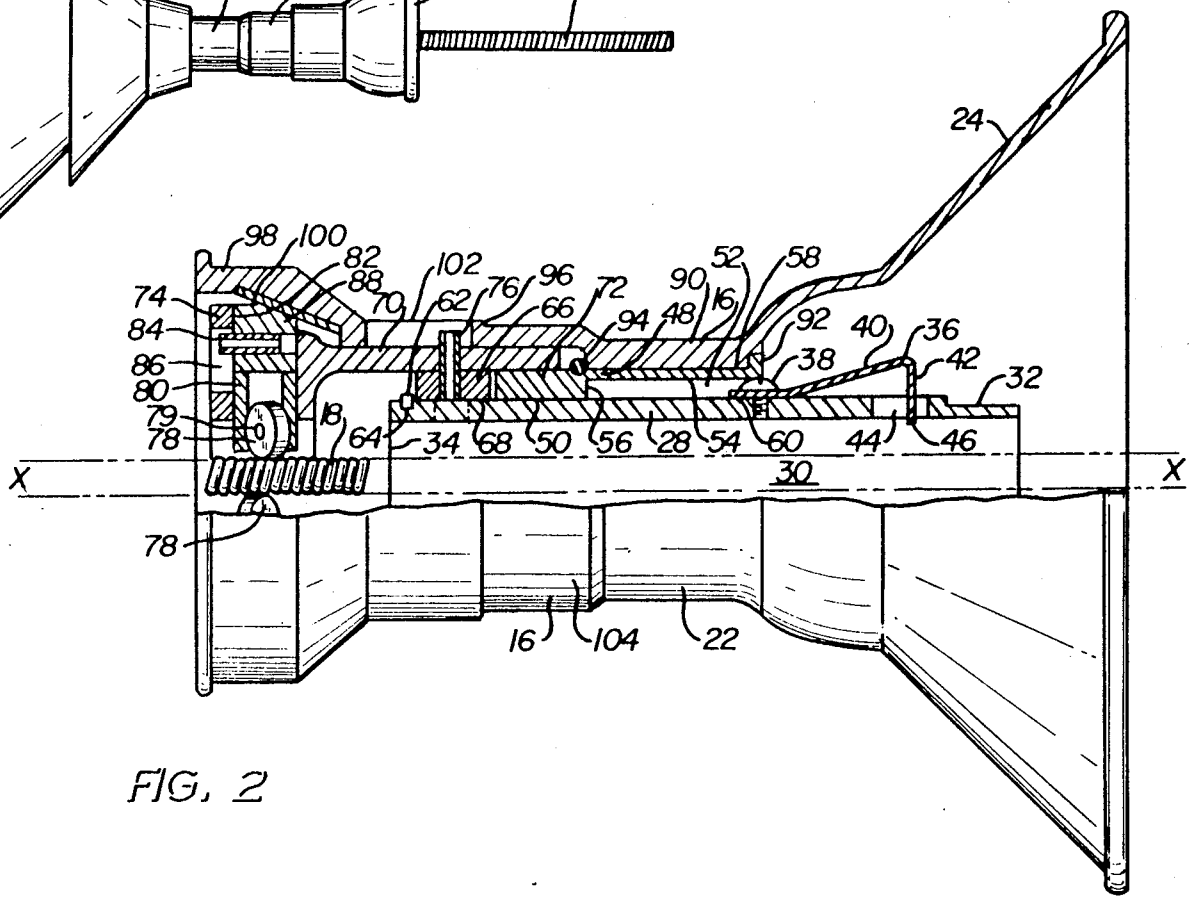
FIG. 2 is a partially sectioned side elevation of a fragmentary part of the plumbers snake apparatus from FIG. 1 in reversed axial orientation and showing the lock and power feed elements of the instant invention with the actuator in one operative position thereof.

Referring now to FIG. 2, the forward end of apparatus 10, which includes actuator 16, is comprised of an elongated, generally cylindrical spindle 28 extending on an axis X—X and having an axial through opening 30 within which snake 18 extends. Spindle 28 includes a mounting end portion 32 which is non-rotatably secured coaxially with respect to the opening or aperture in the canister from which snake 18 protrudes. Upon actuation of drill 14 to drive the enclosure 12 and the contained canister and snake 18 in rotation, spindle 28 rotates in unison with them. Snake 18 is fed from the canister axially through opening 30 and projects axially outward of the outer open end 34 thereof.

An angular locking spring tab 36 is rigidly affixed to spindle 28 as by a suitable fastener such as a screw 38 and an elongated portion 40 of spring tab 36 extends axially and radially outward with respect to spindle 28. A radially inturned elongated end portion 42 of spring tab 36 protrudes radially through an opening 44 which is formed in the side wall of spindle 28, and a radially innermost end 46 of spring portion 42 is positioned to selectively engage and lock snake 18 upon movement thereof into engagement with snake 18 by bending of spring portion 40 radially inward toward spindle 28.

Encompassing spindle 28 is an elongated, generally stepped cylindrical bearing element 48 which includes an elongated, generally cylindrical bearing surface portion 50 disposed in close fitting slideable relation upon an outer cylindrical surface portion 52 of spindle 28. Bearing element 48 thus is rotatably and axially slideable upon spindle 28 within longitudinal limits defined by longitudinally spaced solid stops as follows.

A cylindrical undercut portion 54 of bearing element 48 extends axially from one end thereof and terminates at an annular step 56. The cylindrical portion 58 of bearing element 48 which is longitudinally and circumferentially coextensive with undercut portion 54 overrides screw 38 as bearing member is moved axially to the right, as shown in FIG. 2, until step 56 engages the retained end 60 of spring element 36. The solid stop for axial movement in the opposed direction or axially to the left in FIG. 2 is provided by a snap ring 62 which is engaged within an external annular groove 64 formed on the outer periphery of spindle 28 adjacent open end 34 thereof. A bearing ring 66 encompasses spindle 28 intermediate bearing element 48 and snap ring 62 and includes a cylindrical bearing surface portion 68 which is slideably engaged upon spindle surface 52 in the same manner as above described for surface 50 of bearing element 48. When bearing ring 66 is axially engaged upon snap ring 62 and bearing element 48 is similarly engaged with bearing ring 66, this is the opposed limit of axial movement for bearing element 48.

A generally cylindrical feed housing 70 encompasses bearing ring 66 and an axially outer end 72 of bearing element 48, and includes an axially outwardly projecting end portion 74 to provide a carrier portion for feed elements to be described. A roll pin 76 is engaged within mutually aligned radially extending bores formed in feed housing 70 and bearing ring 66 to retain these elements immobile with respect to one another.

The abovementioned feed elements are comprised of a plurality of circumferentially spaced, cam actuated rollers 78 which are carried for rotation upon respective axes 79 by slide elements 80 disposed within radially extending slide channels 82 formed in the feed housing end portion 74. A roll pin 84 projects from each slide element 80 into a corresponding radially extending slot 86 to limit radial movement of slide elements 80 with respect to the central longitudinal axis X—X of the apparatus and to retain rollers 78 at a proper offset angle with respect to the axis X—X. Slide elements 80 include respective radially outer cam follower portions 88 for cooperation with a camming surface to be described hereinbelow which actuates the feed rollers 78.

A preferably but not necessarily unitary shield and sleeve element 90 coaxially encompasses the above described elements and is axially secured with respect to bearing element 48 as by flange 92 or other suitable interlocking structure and a retention ring element 94. An axially innermost end portion of sleeve element 90 forms the shield 24 whereas an axially outer end portion 96 forms a combined hand grip, housing and feed actuator as follows.

End portion 96 overrides the axially inner extension of feed housing 70 and is enlarged adjacent its outermost end 98 to enclose the outer end portion 74 of feed housing 70. Within the inner perimeter of end portion 98 of sleeve 90 are camming surfaces 100 which are engageable with cam follower portions 88 to drive feed rollers 78 radially into engagement with snake 18. In order to provide this camming action, the sleeve member 90 must be axially moveable with respect to feed housing 70. Accordingly the, roll pin 76 which secures feed housing 70 and bearing ring 66 together also projects radially outward thereof into an axially elongated slot 102 whereby sleeve 90 is axially moveable with respect to drive housing 70 within the limits of movement of roll pin 76 within slot 102.

From the above description, the operation of plumbers snake apparatus 10 will be readily understood. An outer surface portion 104 of sleeve 90 provides the hand grip 22 of the actuator portion 16. Upon grasping surface 104, a user is able to slide sleeve 90 axially to and fro to provide control functions as follows. In FIG. 2, the sleeve 90 is shown in its forwardmost axial position. Feed housing 70 is at its furthest extended axial position with bearing ring 66 in engagement with snap ring 62, and sleeve element 90 has been moved axially forward with respect thereto so that cam surfaces 100 have engaged the respective cam followers 88 thus driving rollers 78 radially inward into engagement with snake 18. Upon actuation of the power drive, the snake 18, its canister, and related elements including bearing 48 rotate axially with respect to the rotationally stationary sleeve 90. The grip of offset rollers 78 upon the rotating snake 18 provides the power feed of snake 18 as rotation proceeds. With a plurality of the rollers 78, preferably three rollers 78 distributed at regular intervals circumferentially of snake 18, the drive apparatus is self centering and can accommodate snakes of varying diameters and pitches. In the position shown in FIG. 2, the lock element 36 is radially retracted and thus disengaged from snake 18 which extends adjacent thereto.

Figure 3:
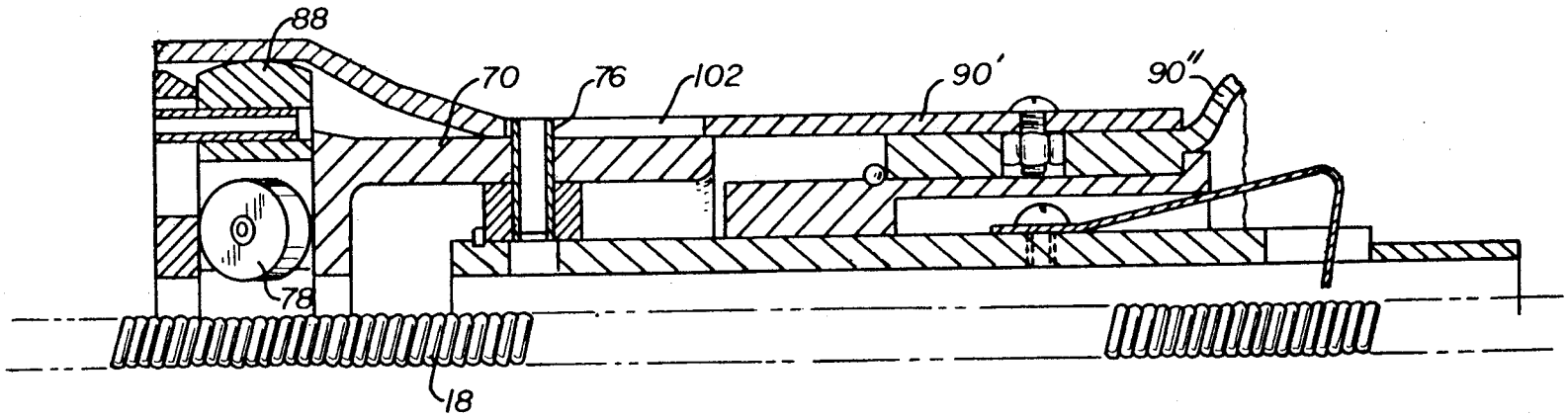
FIG. 3 is a fragmentary sectioned side elevation similar to FIG. 2 showing another operative position of the actuator.

FIG. 3 illustrates an alternative embodiment of the invention which is similar in most salient respects to that shown in FIG. 2, except that sleeve 90 is not a unitary structure, being formed instead of separate elements including a sleeve 90' and a shield 90''. In addition, camming surface which cooperates with cam followers 88 is a two stage cam having axially adjacent surface portions of differing slope or angle for differing degrees of roller slide actuation and mechanical advantage.

The operating position for the apparatus as shown in FIG. 3 is a neutral or intermediate position wherein sleeve 90 has been retracted axially from the position shown in FIG. 2 thereby releasing cam follower portions 88 and allowing rollers 78 to release their drive grip upon snake 18. It will be noted that the longitudinal freedom afforded by slot 102 permits axial retraction of sleeve 90' with respect to feed housing 70 to permit the described actuation and de-actuation of feed rollers 78.

Figure 4:
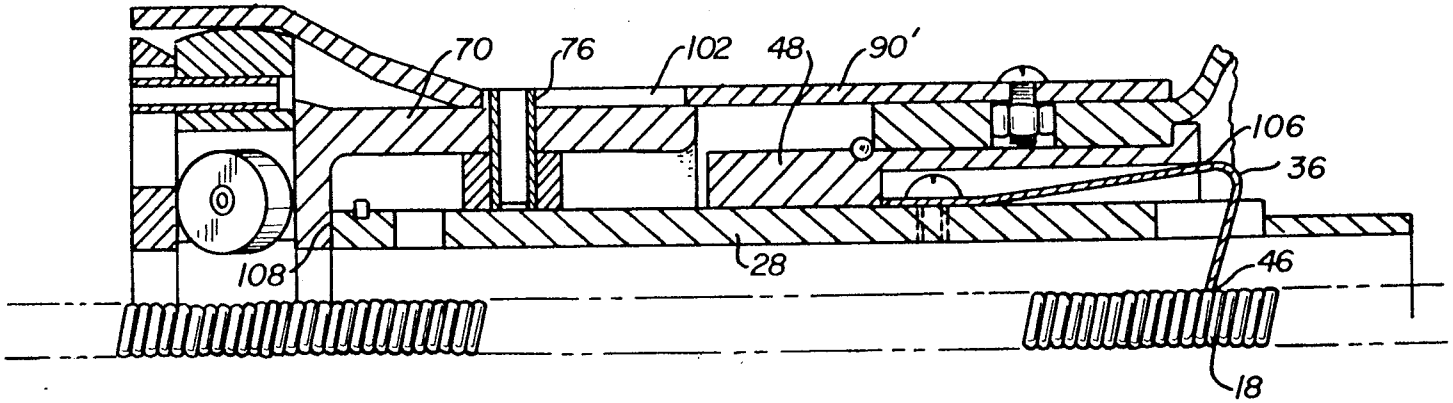
FIG. 4 is a fragmentary sectioned side elevation similar to FIG. 3 showing a further operative position of the actuator.

A third operative position for the apparatus is shown in FIG. 4 with sleeve 90' further retracted axially from the neutral position of FIG. 3 to the lock configuration whereat an axially innermost end 106 of bearing member 48 has engaged and overridden the spring tab 36 thus driving the radially inner end 46 thereof radially into engagement with snake 18 and locking snake 18 against axial movement in either the infeed or outfeed directions. It will be noted that upon movement of sleeve 90' from the neutral position of FIG. 3 to the lock position of FIG. 4, the feed housing 70 must follow as the limit of axial motion for roll pin 76 within slot 102 has been reached upon attainment of the neutral position shown in FIG. 3. Feed housing 70 thus is drawn axially inward to an extreme axial position in engagement with an outermost end surface 108 of spindle 28.

Figure 5:
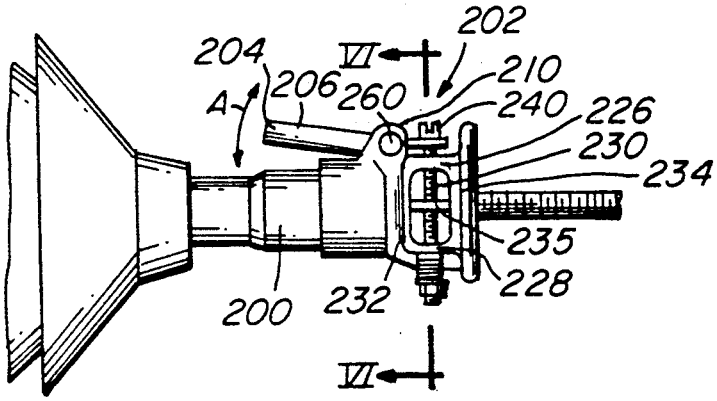
FIG. 5 is a side elevation similar to FIG. 1 showing an alternative embodiment of the invention.
Figure 6:
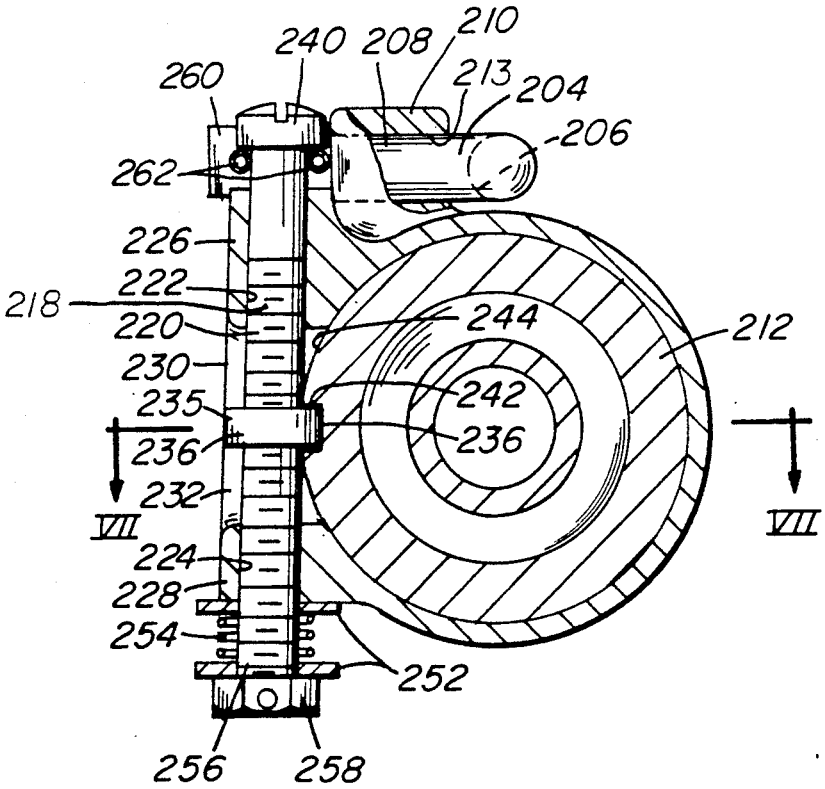
FIG. 6 is a sectional view taken on line VI—VI of FIG. 5.

An alternative embodiment of the invention is shown in FIGS. 5 through 8. In FIG. 5 there is shown a plumber's snake apparatus that is similar in many salient respects to that described hereinabove with reference to FIGS. 1 to 4. Specifically, in the embodiment of FIG. 5, the actuator and control assembly 200 is moveable axially just as above described between axially spaced drive and lock positions, with the drive position being a relatively forward position of actuator 200 and the lock position being a relatively rearward axial position.

The FIG. 5 embodiment also contemplates means for enhancing the drive or feeding engagement of the offset rollers as above described which is operable in cooperation with the actuator assembly 200 upon movement thereof to the forward feed engagement position. Specifically, there is shown in FIG. 5 a lever actuated feed control generally indicated at 202 and comprised of an elongated rigid lever 204 having a handle portion 206 which extends adjacent the actuator sleeve 200, and a pivotally mounted portion 208 (FIG. 6) which extends generally perpendicular to handle portion 206. Actuator assembly 200 further includes an integrally formed boss portion 210 of sleeve 200 having a through bore 213 within which the pivotally mounted portion 208 of lever 204 is retained for pivotal movement with respect to actuator sleeve 200.

Bore 213 is oriented with respect to actuator sleeve 200 such that upon pivotal movement of lever 204 therein, handle portion 206 moves toward or away from actuator sleeve 200 in the directions indicated by arrow A.

The lever 204 is operable to axially rotate a feed housing 212 which is carried coaxially within an outer open end 214 of actuator sleeve 200 in the same manner that the above described feed housing 70 is received within the outer open end of actuator and control assembly 16. Feed housing 212 carries a plurality of radially moveable offset feed rollers 216 as above described with reference to FIGS. 1 to 4; however, for the embodiment of FIGS. 5 to 8, actuation of feed rollers 216 to engage a snake is achieved not only by a camming action resulting from axial movement of sleeve 200, but in addition by a camming action which results from axial rotation of feed housing 212, as will be more fully described hereinbelow.

To engage lever 204 with feed housing 212 to permit manipulation of lever 204 to rotate housing 212 incrementally, a linkage arrangement generally indicated at 218 is provided in the form of an elongated threaded bolt 220 which extends within coaxially aligned through openings 222, 224 in a respective pair of bosses 226, 228 which are preferably formed integrally with actuator sleeve 200 at a position offset longitudinally from boss 210.

Between bosses 226 and 228 is a pocket 230 that is bounded on its opposed sides by side wall portions 232 and 234 which preferably are formed integrally with the bosses 226 and 228 to thereby form the outwardly open pocket 230. Bolt 220 extends within pocket 230 between the bosses 226 and 228, and a preferably square, threaded nut 235 is threadedly engaged upon bolt 220 within pocket 230 and is of a dimension that opposed flanks 236 of the square exterior periphery of nut 235 are disposed closely adjacent respective opposed inner surfaces 238 (FIG. 7) of side walls 232 and 234 to thereby prevent turning of nut 235 within pocket 230. Accordingly, turning of bolt 220, as by engagement of a screwdriver in the slot of a slotted head portion 240 thereof, causes nut 235 to be moved selectively to and fro within pocket 230.

Another exterior flank surface 236 of nut 235 is engaged within a generally rectangular section elongated groove 242 formed in an outer peripheral portion 244 of feed housing 212. Accordingly, upon movement of nut 235 axially with respect to the axis of bolt 220 within pocket 230, feed housing 212 is moved incrementally in rotation about its longitudinal axis.

Figure 7:
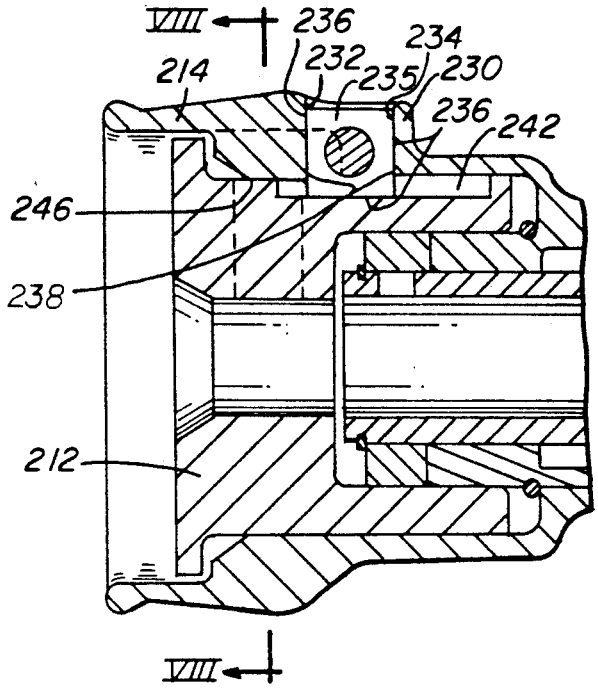
FIG. 7 is a sectional view taken on line VII—VII of FIG. 6.
Figure 8:
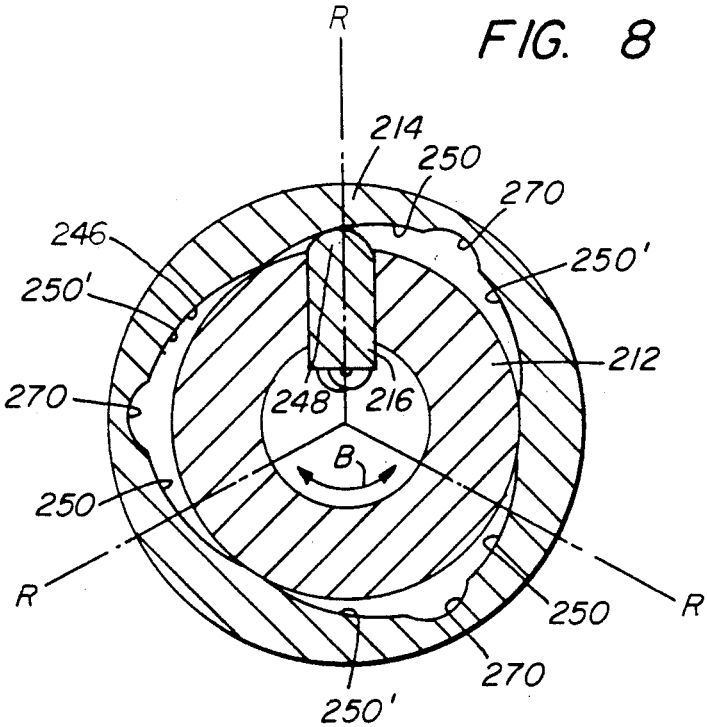
FIG. 8 is a sectional view taken on line VIII—VIII of FIG.

As may be seen from FIG. 8, at the plane of section lines VIII—VIII of FIG. 7 the inner periphery 246 of sleeve portion 214 is formed as a camming surface which is cooperable with the radially outermost end 248 of the respective offset roller assemblies 216, only one of which is shown in FIG. 8. In practice, typically three offset roller assemblies 216 would be provided at positions spaced 120° apart about the periphery of feed housing 212, for example as indicated by radials R in FIG. 8.

Upon rotational movement of feed housing 212 as indicated by arrows B in FIG. 8, the radially outer ends 248 of the roller assemblies 216 cooperate with respective camming surfaces formed on the inner periphery 246 of sleeve 214 to urge the roller assemblies 216 radially inward into engagement with a snake element, or to permit roller assemblies 216 to move radially outward and out of engagement with such a snake element. This engagement and disengagement of roller assemblies 216 is also effected by actuation of lever 204 to move bolt 220 axially as follows.

It is first to be noted that bolt 220 is provided with a pair of spaced apart washers 252 and a coil spring 254 extending therebetween, all coaxially disposed upon an outer free end 256 of bolt 220 which extends outwardly of boss 228. A threaded nut 258 is engaged upon the outermost end of the bolt 220 to thereby retain washers 252 and spring 254 thereon, preferably with spring 254 in a compressed state.

At the opposed end of bolt 220, the head portion 240 thereof is disposed in an offset relation with respect to an end portion 260 of lever 204 which projects outwardly of boss 210. A pair of roll pins 262 or similar elements project transversely from lever end portion 260 on either side of bolt 220 and are captured beneath head portion 240. Accordingly, upon rotation of lever handle 206 toward sleeve 200, roll pins 262 rotate away from the sleeve 200 thereby engaging the underside of bolt head 240 and drawing the bolt 220, together with nut 235, in the upward direction as viewed in FIG. 6 thus further compressing spring 254. Upon release of lever handle 206, the bias of spring 254 returns the bolt 220 and nut 235 to their extreme downward position as viewed in FIG. 6.

Manipulation of lever handle 206 thus is effective to move nut 235 tangentially with respect to feed housing 212 whereby the engagement of nut 235 within groove 242 incrementally rotates housing 212 about its central longitudinal axis. Such rotation moves offset roller assemblies 216 in engagement with camming surfaces 250 to either drive the offset rollers forcefully into engagement with a snake element, or to permit the offset rollers to disengage such a snake element.

It will be noted that the location of camming surfaces 250 is such that manipulation of lever 206 to rotate feed housing 212 will be ineffective when sleeve portion 214 is in its rearward position, corresponding to the lock position as hereinabove described, as in that position the rollers 216 would not be longitudinally aligned with camming surfaces 250. In this regard, it is to be noted that axial sliding of sleeve portion 214 is operative to provide initial engagement of rollers 216 on the snake element upon moving sleeve portion 214 to its forwardmost position just as in the above described embodiments of FIGS. 1 to 4.

Accordingly, the availability of easy adjustment for the position of nut 235 by turning bolt 220 permits the radial position of rollers 216 upon the initial sliding of sleeve portion 214 to its forward position, and prior to actuation of lever 206, to be selected quite precisely. As a result, the bolt 220 provides means for adjusting the position of rollers 216 so that they will engage a snake element upon initial movement of actuator sleeve 200 to its forward or feed position whereby additional force of roller engagement upon the snake element is provided by squeezing lever handle 206 toward sleeve 200.

An additional benefit of the described adjustment capability is that it permits the apparatus to be used with equal facility for snake elements of differing diameters.

It will be noted that the biasing force by which rollers 216 are biased into engagement with a snake element through axial movement of bolt 220 may be effected either by force applied to lever handle 206 or by the bias of spring 254. That is, if it is desired that lever 206 be utilized to apply radial biasing force to roller 216, then spring 254 functions as a retraction or automatic return element to ensure that the biasing force of rollers 216 on the snake element will release automatically upon release of lever 206. This is considered to be a useful although not an essential feature as the camming angle of the cam surfaces 250 is not shallow enough that it would be subject to a self locking condition when rollers 216 are engaged with a snake element. That is, the camming angles of surfaces 250 are such that upon release of lever 206, the reaction forces between roller assembly upper end 248 and camming surface 250 would allow the roller assembly upper ends 248 to ride up the camming surface 250 and thereby relieve the roller force on the snake element.

In some circumstances, it may be desirable to have the roller bias provided by spring 254, in which event the spring rate and precompression of spring 254 are to be selected to provide the magnitude of bias desired. Lever handle 206 in this instance is used not to engage roller assemblies 216 on the snake element but to incrementally compress spring 254 thereby counteracting or overcoming its bias and rotating the feed housing 212 to a non-engaged position for roller assemblies 216 on camming surfaces 250. In this event also, because camming engagement of roller assemblies 216 on a snake element is achieved by rotation of feed housing 212 in the opposite rotary direction from that which provides roller engagement upon actuation of lever handle 206 as above described, the companion camming surfaces 250' would be utilized to effect roller engagement under the biasing impetus of spring 254, so that upon release of level handle 206 the biasing action of spring 254 will rotate feed housing incrementally thereby moving the roller assemblies 216 radially inward along the slope of the respective camming surfaces 250'.

Intermediate the adjacent pairs of camming surfaces 250 and 250' are respective indentations 270 which provide the maximum radially outward clearance for roller assemblies 216. A snake element typically has an enlarged free end. In order to accommodate convenient assembly and disassembly of feed assembly 200 on a snake element coiled within a canister as above described, radial clearance of the rollers 216 is necessary to clear the enlarged end of the snake. In this embodiment, such clearance is provided by suitable adjustment of bolt 220 to thereby rotate feed housing 212 to a position where offset rollers 216 are radially aligned with recesses 270 whereby roller assemblies 216 are free to move radially outward to the maximum extent or are spring biased to spontaneously move radially outward thereby permitting the enlarged free end of a snake element to pass through the central opening of the feed housing.

From the above description it will be seen that we have invented a novel and improved plumbers snake apparatus in which a single forwardly projecting structure enclosing the flexible snake as it projects from its canister provides combined functions of a manual support and multiple operative functions of lock actuator and power feed actuator together with a neutral non-actuating configuration, all by means of axial sliding of the manual hand grip or support with respect to the canister. Control and handling or manipulation of the apparatus, as well as operative convenience are thus greatly enhanced and the ease and convenience of the user's chore correspondingly improved.

Of course we have envisioned various alternative and modified embodiments of the invention other than those described hereinabove, and such would surely also occur to others versed in the art once they were apprised of my invention. For example, we have contemplated the modification of a spring bias element placed in encompassing relation about the spindle and extending axially between elements which provide relative sliding engagement, for example between the feed housing 70 and the sleeve 90, to provide spring biased return of the apparatus to the neutral position. Additionally, we have contemplated the inclusion of a locking notch in the nature of a bayonet lock at the right axial end of slot 102 (as viewed in FIG. 2) to permit the user to lock the apparatus in the power feeding mode by a simple twist of the hand grip element. Accordingly, it is intended that the invention be construed broadly in accordance with the scope of the claims appended hereto.

I claim:

1. In a sewer augering apparatus wherein an elongated flexible snake is moveable in axial rotation as it progresses in an axial direction, an apparatus for controlling actuation of such a snake element comprising:

feed means cooperable with such a snake element by selective engagement with exterior peripheral portions thereof to impart axial feeding impetus to such a snake element in response to axial rotation thereof;

lock means selectively engageable with such a snake element to selectively lock such a snake element against axial movement; and actuator means comprised of an elongated actuator element which is coaxially arranged with respect to such a snake element and is manually slideable axially of such a snake element between axially spaced positions including a feed actuating position whereat said actuator means is cooperable with said feed means to engage said feed means in operative engagement with such a snake element, and a lock actuating position spaced axially from said feed actuating position and whereat said actuator means is cooperable with said lock means to maintain said lock means in operative engagement with such a snake element.

2. The apparatus as set forth in claim 1 wherein said actuator means additionally includes a hand held support means for permitting manual support of said sewer augering aparatus.

3. The apparatus as set forth in claim 2 wherein said actuator means includes elongated generally cylindrical sleeve means encompassing a rotary spindle portion of such a sewer augering apparatus and such a snake element.

4. The apparatus as set forth in claim 3 wherein said feed means includes a plurality of roller means which are engageable with such a snake element and are rotatable on axes which extend at an acute angle with respect to the axis of such a snake element.

5. The apparatus as set forth in claim 4 wherein said lock means includes a spring biased tab means which is movable against the impetus of its own biasing force into engagement with such a snake element.

6. The apparatus as set forth in claim 5 additionally including a neutral position of said actuator means intermediate said axially spaced positions whereat said feed means and said lock means are unactuated.

7. In a sewer augering apparatus wherein a flexible elongated snake element is selectively feedable in an axial direction from a canister by a power feed means which is engageable with such a snake element and is operable by relative rotation between the power feed means and the snake element, and a lock means is operable to selectively engage and lock such a snake element against axial movement in either axial direction with respect to such a canister, an actuator means for actuating such feed and lock means comprising:

an elongated sleeve means encompassing an axially extending portion of such a sewer augering apparatus through which such a snake element extends;

said sleeve means including a first actuator portion located for selective actuation of such a feed means upon movement of said sleeve means in one axial direction to a first axial position; and said sleeve means including a second actuator portion located to actuate such a lock means upon movement of said sleeve means axially to a second axial position spaced from said first axial position.

8. The actuator means as set forth in claim 7 wherein both of said first and second actuator portions include camming means which are engageable with such feed and lock means, respectively.

9. The actuator means as set forth in claim 8 additionally including enlarged diameter shield means extending coaxially from said sleeve means.

10. The actuator means as set forth in claim 9 wherein at least one of said cam means includes a multi-stage camming surface.

11. The actuator means as set forth in claim 9 additionally including a generally cylindrical manual handgrip surface means located adjacent said shield means.

12. In a sewer augering apparatus wherein a flexible elongated snake element is selectively feedable in an axial direction from a canister, the combination comprising:

an elongated, generally cylindrical spindle means having an axial through opening adapted to have such a snake element extending therethrough and means adjacent one axial end of said spindle means adapted for connection to such a canister for concomitant rotation of said spindle means with such a canister;

power feed means carried by said spindle means and engageable with such a snake element for axial feeding thereof from such a canister and through said spindle means;

lock means carried by said spindle means and operable to selectively engage and lock such a snake element against axial movement in either axial direction with respect to said spindle means;

an elongated sleeve means coaxially encompassing said spindle means;

means mounting said sleeve means with respect to said spindle means in a manner that said sleeve means is axially and rotationally moveable with respect to said spindle means;

said sleeve means including a first actuator portion located for selective actuation of said power feed means upon movement of said sleeve means in one axial direction with respect to said spindle means to a first axial position; and said sleeve means including a second actuator portion located to actuate said lock means upon movement of said sleeve means axially with respect to said spindle means to a second axial position spaced from said first axial position.

13. The apparatus as set forth in claim 1 wherein said actuator means includes a first cam means which is operable to move said feed means for operative engagement thereof with such a snake element upon axial movement of said actuator element toward said feed actuating position.

14. The apparatus as set forth in claim 13 wherein said actuator means additionally includes second cam means which is cooperable with said feed means when said actuator means is disposed in said feed actuating position to engage said feed means in operative engagement with such a snake element in response to axial rotation of said feed means with respect to said actuator element.

15. The apparatus as set forth in claim 14 additionally including elongated link means carried by said actuator element and having a longitudinal axis, said link means being axially moveable in the direction of said longitudinal axis and being operably engaged with said feed means to move said feed means in axial rotation with respect to said actuator element upon axial movement of said link means.

16. The apparatus as set forth in claim 15 additionally including a manually operable lever actuator carried by said actuator means and cooperable with said link means to impart axial movement thereto.

17. The apparatus as set forth in claim 15 wherein said link means includes adjustment means for selectively moving the location of operable engagement of said link means with said feed means.

18. The apparatus as set forth in claim 17 wherein said adjustment means is operable for said selective moving upon axial rotation of said link means.

* * * * *